United States Patent [19]

Kauf

[11] 3,944,161

[45] Mar. 16, 1976

[54] TAPE LAYING DEVICE AND METHOD

[76] Inventor: Russell D. Kauf, R.D. No. 3, West Salem, Ohio 44287

[22] Filed: July 10, 1974

[21] Appl. No.: 487,186

[52] U.S. Cl. ..... 242/96; 156/579

[51] Int. Cl.[2] ..... B65H 75/40

[58] Field of Search ..... 242/96, 86.52, 84.2 J, 242/55.2, 7.06, 7.23; 254/134.3 R; 156/579, 577, 523, 527

[56] References Cited

UNITED STATES PATENTS

| | | | |
|---|---|---|---|
| 3,026,052 | 3/1962 | Wade | 242/96 X |
| 3,211,604 | 10/1965 | Rymer | 156/577 |
| 3,318,753 | 5/1967 | Whitlow | 156/579 X |
| 3,463,694 | 8/1969 | DeRoshia | 156/523 |
| 3,731,887 | 5/1973 | Wheeler | 242/96 |

*Primary Examiner*—Edward J. McCarthy
*Attorney, Agent, or Firm*—Wallenstein, Spangenberg, Hattis & Strampel

[57] ABSTRACT

A portable, hand manipulated device for laying flexible, stretchable and tearable plastic films and metal foil warning tapes, for example, in a trench in which an element of construction such as a telephone cable, a gas main, a water main, or the like, has been installed. The device enables the tapes to be positioned, during backfilling, along a side wall of the trench at any preselected depth in the trench and at a height above the level of the element of construction installed therein.

6 Claims, 7 Drawing Figures

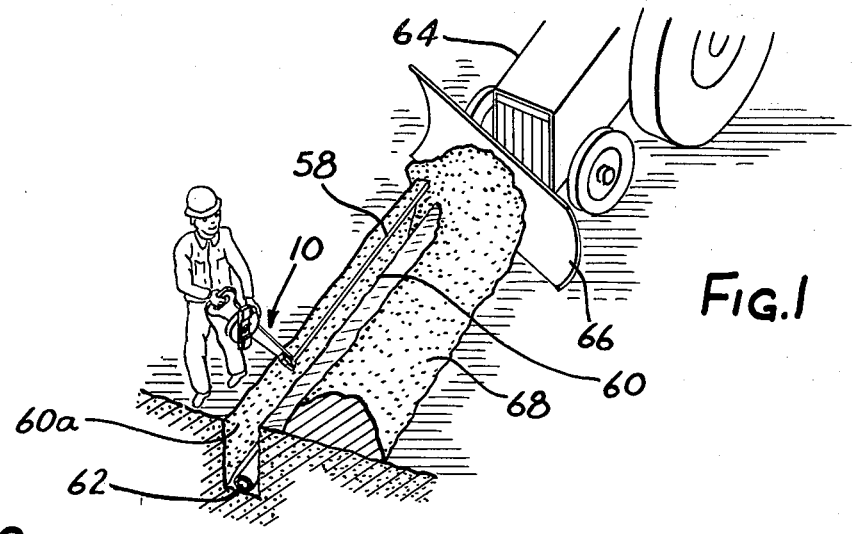
FIG.1
FIG.2
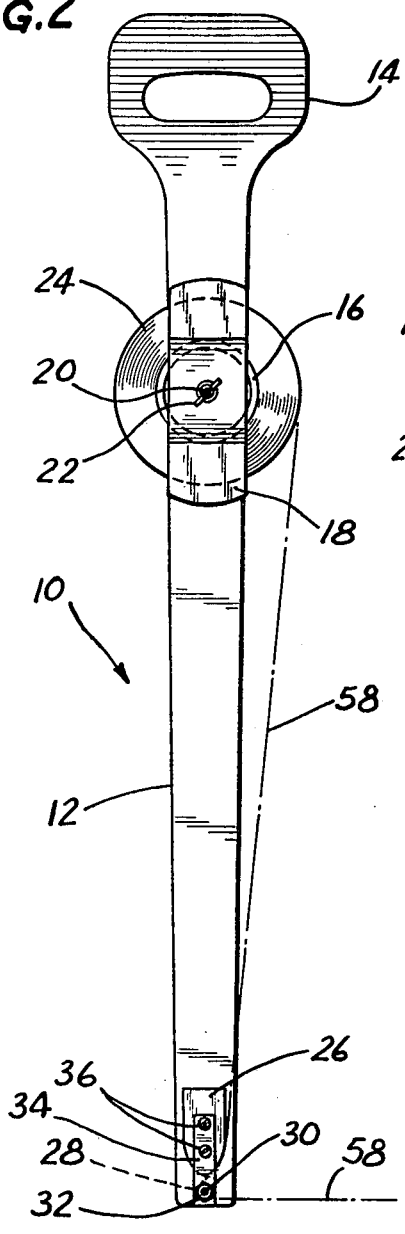
FIG.3
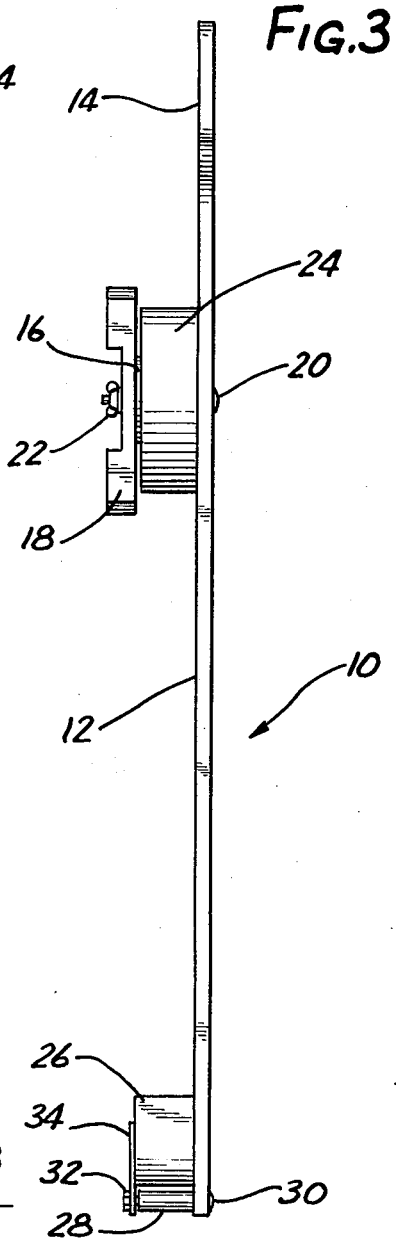

TAPE LAYING DEVICE AND METHOD

The present invention relates to a portable, hand manipulated device, and method, for laying warning tape and the like, in a trench dug in the earth in which an element of construction such as a telephone cable, a gas main, a water main, a sewer line, an electric service line, or the like, has been installed.

The significant and important practical advantages involved in the utilization of plastic film and metal foil warning tapes to facilitate the location, presence and identification of buried elements of construction have resulted in the widespread use of such film and metal in the form of sheets or tapes (hereafter, for convenience, simply called "tapes") in new, as well as existing, underground installations of telephone cables, gas mains, sewer lines, water mains, electric service line, and the like. The nature of such tapes and the advantages accruing from their use are disclosed in U.S. Pat. Nos. 3,282,957, 3,504,503, and 3,633,533.

Typically, the procedure followed in the utilization of warning tapes in the installation of buried elements of construction includes the steps of digging a trench, placing an element of construction such as a telephone cable in the trench, partially backfilling the trench to provide a layer of backfill of appreciable depth over the element of construction, laying the warning tape in a flat position on the backfill in the partially backfilled trench, and then completing backfilling of the trench. The warning tape generally is layed in the partially backfilled trench from a roll carried on a wheeled, motor-driven vehicle which also may be adapted to backfill the trench.

The procedure outlined above has a number of shortcomings, chief among which are the need for a second backfilling operation to cover the warning tape and to complete the backfilling of the trench, and the utilization of motorized, generally cumbersome and expensive equipment to lay the tape in the trench.

In accordance with the present invention, a device for laying warning tapes in a trench is provided which eliminates the need for a second backfilling operation. Moreover, in marked contrast to the equipment heretofore employed to lay warning tapes, the device of this invention is portable, is readily held in the hands of a user, is light in weight and is easily manipulatable. Also, in contrast with certain types of prior tape laying equipment, the device of this invention enables warning tapes to be placed simply and inexpensively in a trench with its front and rear surfaces substantially parallel to the side walls of a trench, or, in other words, generally vertically in relation to the surface of the earth, as opposed to the flat position or generally horizontal position in which it is commonly layer with standard tape laying equipment. Thus, the wider faces of the tape, rather than the extremely narrow side edges of the tape, are presented to a digging tool such as a back hoe which may be working in the area of the buried element of construction.

The device, in brief, comprises an elongated, somewhat tapered body portion having warning tape supply support means attached thereto. The tape supply advantageously is in roll form, and is maintained on the support means by an adjustable retaining member. One end of the body portion desirably is provided with a handle to enable the device to be easily carried and manipulated by a user. The body portion is further provided with tape guide means for receiving and guiding the tape as it unwinds from the roll carried on the tape supply support means. The tape guide means enables a user of the device easily to maintain proper tension on the tape as it unwinds from the tape supply roll during installation. In one form of the device, the tape guide means is secured on the body portion in a fixed position. In a modified form of the device, adjusting means is provided to enable the position of the tape guide means to be changed in relation to the longitudinal axis of the body portion thereby facilitating laying of the tape in a trench during backfilling.

The foregoing and other advantages and features of the invention will be more fully realized and understood from the following description when taken in conjunction with the accompanying drawings wherein like reference numerals throughout the various views of the drawings are intended to designate similar elements or components.

FIG. 1 is a perspective view illustrating a typical warning tape laying operation, utilizing the device of this invention, as backfilling of a trench containing an element of construction is taking place;

FIG. 2 is a front view in elevation of an embodiment of the device of this invention;

FIG. 3 is a side view in elevation of said embodiment;

Figure 4:
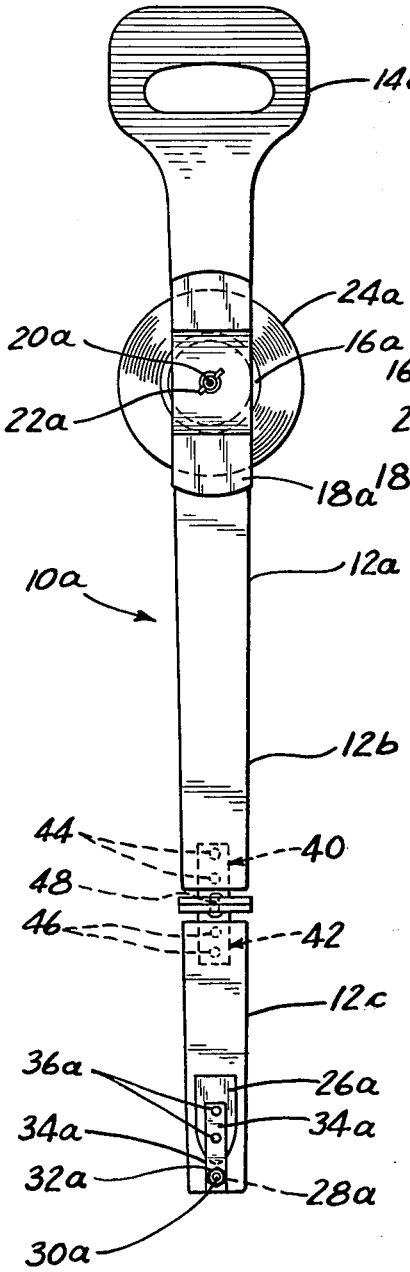
FIG. 4 is a front view in elevation of another embodiment of the device.

Referring, now, in particular, to FIGS. 2 and 3 of the drawings, the embodiment of the device there illustrated, and designated by the numeral 10, comprises an elongated, gently tapered body portion 12 which may be formed of wood, a rigid plastic material, or a lightweight metal such as aluminum. The body portion 12, at its upper end, is joined to a handle portion 14 which, in the embodiment shown, is conveniently formed integrally with the body portion 12.

Below the handle portion 14, and at a point conveniently above the middle of the body portion 12, a tape supply support member 16, including a removable tape supply retaining member 18, is secured to the body portion 12 by means of a bolt 20 desirably provided with a wing nut 22. The member 16 advantageously is cylindrical in shape to enable it to receive and support a roll 24 of warning tape. The diameter of the cylindrically shaped member 16 is such that the core of the roll 24 will turn easily on the member 16 as the tape unwinds from the roll 24 during a tape laying operation. The length of the member 16 is such that it will accommodate rolls of different widths. The bolt 20, as shown, extends through the body portion 12, the support member 16 and the retaining member 18. The center portion of the member 18 is recessed sufficiently to receive the end of the bolt 20 and the wing nut 22 thereby reducing the possibility of inadvertent contact by the hands of a user of the device with the end of the bolt and the wing nut.

Secured to the lower end of the body portion 12, in spaced relation to one another, are a tape guide member 26 and a tape roller 28. The lower end of the member 26, as shown, is rounded and tapered inwardly. The roller 28 is journaled for rotation about a pin 30, one end of which is secured by a nut 32 to the lower end of a connecting plate 34. The plate is provided with openings for receiving screws 36—36 by means of which the member 26 is secured to the body portion 12.

Referring, now, to FIGS. 4 through 7 of the drawings, a modification of the device 10 is shown. The device 10*a*, as illustrated, like the device 10, comprises an elongated body portion 12*a*, having a handle portion 14*a*, joined thereto at its upper end. Also, like the device 10, the body portion 12*a* of the device 10A has a tape supply support member 16*a* and a retaining member 18*a* secured to it by a bolt 20*a* and a wing nut 22*a*. The member 16*a* is adapted to receive and support a roll 24*a* of warning tape. Again, as in the case of the device 10, the lower end of the device 10*a* is provided with a tape guide member 26*a* and a tape roller 28*a* secured to the body portion 12*a* by means of screws 36*a*—36*a*, and pin 30*a* and nut 32*a*, respectively, which pass through openings in a connecting plate 34*a*.

The device 10*a* differs from the device 10 in that the body portion 12*a* thereof comprises two sections 12*b* and 12*c* which are interconnected by brackets 40 and 42. As shown, the upwardly extending leg 40*a* of the bracket 40 is secured to the section 12*b* by screws 44—44, while the downwardly extending leg 42*a* of the bracket 42 is secured to the section 12*c* of the body portion 12*a* by screws 46—46.

The bracket 40 and 42 are interconnected by a pivot pin or rivet 48 which enables the section 12*c* to be pivoted in relation to the section 12*b* of the body portion 12*a*. In the embodiment illustrated, the bracket 42 has a fan-shaped extension 42*b* having an opening therethrough for receiving the shaft of a bolt 50. Indicia desirably are provided on the upper face of the extension 42*b* of the bracket 42 to enable a user to more accurately select the degree of rotation of the section 12*c* with relation to the section 12*b* of the body portion 12*a*.

The bracket 40 has a fan-shaped extension 40*a* which partly overlies the extension 42*a* of the bracket 42. The extension 40*a* is provided with an arcuate slot 52 through which the shaft of the bolt 50 extends. A nut 54 is provided for the bolt 50.

Figure 5:
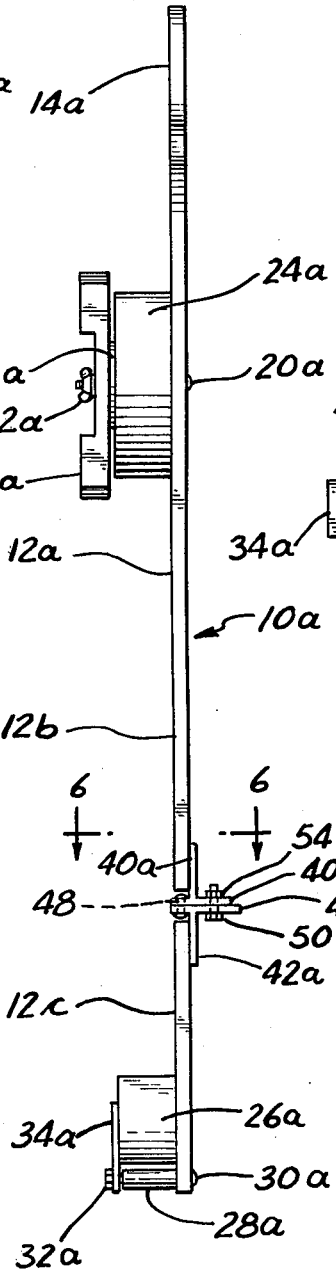
FIG. 5 is a side view in elevation of the embodiment shown in FIG. 4.
Figure 6:
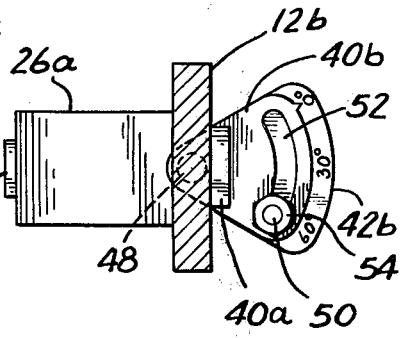
FIG. 6 is a sectional view taken substantially along line 6—6 of FIG. 5.
Figure 7:
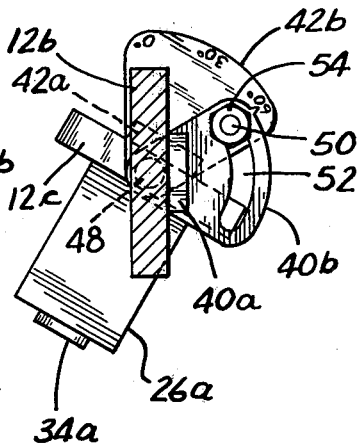
FIG. 7 is a view corresponding to the view of FIG. 6 showing the tape guide means rotated at an angle to the longitudinal axis of the body portion of the device.

FIG. 6 of the drawings shows the position of the extensions 40*b* and 42*b* of the brackets 40 and 42 when the sections 12*b* and 12*c* of the body portion 12*a* are aligned as illustrated in FIGS. 4 and 5. FIG. 7 shows the position of the extensions 40*b* and 42*b* when the section 12*c* has been pivoted through an angle of approximately 60° about the pin 48. The section 12*c* can be secured in this position by simply tightening the nut 54 on the bolt 50. By thus enabling the section 12*c* to be pivoted in relation to the section 12*b* of the body portion 12*a* of the device 10*a*, the angle of the tape guide member 26*a* and the cooperating tape roller 28*a* with relation to the longitudinal axis of the body portion 12*a* can be changed to facilitate positioning of the warning tape at the desired depth against the side wall of a trench during backfilling.

As shown in FIG. 2 of the drawings, the roll 24 of warning tape is secured for rotation on the tape supply support member 16 by means of the retaining member 18 and the wing nut 22. The end of the tape 58 is passed across the side of the tape guide member 26 which corresponds to the side of the roll 24 from which the tape will unwind during installation of the tape. The end of the tape 58 is then passed through the space between the rounded end of the tape guide member 26 and the tape roller 28, and then around and under the tape roller 28 so that it is again on the same side of the roll 24 from which the tape will unwind. The same practice would, of course, be followed in the case of the device 10*a*, with the exception that the angle of the tape guide member 26*a* and the tape roller 28*a* with relation to the longitudinal axis of the body portion 12*a* can be changed, as desired, to facilitate laying of the tape in a trench.

In FIG. 1 of the drawings, the device 10 of this invention is shown in use. As illustrated, a trench 60, with an element of construction such as a gas main 62 installed therein, is being backfilled by means of a tractor 64 equipped with a blade 66. The user of the device 10 stands on the side of the trench 60 opposite to that on which the backfill bank 68 is located. The end of the warning tape 58 is initially entrapped by the backfill, and as backfilling progresses the tape is held against the side wall 60*a* of the trench 60, at the desired depth, by the user. The tape guide member 26 and the roller 28 in cooperation with the holding action of the backfill enable proper tension to be continuously maintained on the tape as the user walks along the side of the trench 60, and the tape, as a result, unwinds from the roll 24. Complete filling of trench 60 and the laying of the tape 58 are thus accomplished at the same time thereby eliminating the need for two backfilling operations.

What is claimed is:

1. A portable device for laying warning tape, and the like, in a trench containing a utility cable, conduit pipe, or the like, comprising an elongated body portion having handle means at the upper end thereof and tape guide means at the lower end thereof, said tape guide means being secured to one side of the body portion and extending outwardly therefrom, said body portion having a length such that a user can walk upright along an edge of a trench in which tape is being layed while gripping the handle means in one hand and maintaining the tape guide means at a desired level within the trench, and tape support means for holding a supply of tape in roll form to be layed in the trench, said tape support means being positioned on the body portion below the handle means thereof and extending outwardly therefrom on the same side as the tape guide means, said tape support means including tape roll retaining means which is adjustable laterally with relation to the body portion to enable rolls of tape of different widths to be supported on the tape support means.

2. A device according to claim 1 wherein the handle means is formed integrally with the body portion.

3. A device according to claim 1 wherein the tape guide means includes a stationary tape tensioning member, and a rotatable tape tensioning member positioned below and in spaced relation to the stationary tape tensioning member, both members coacting to maintain proper tension on the tape as it is layed in a trench.

4. A portable device for laying warning tape, and the like, comprising an elongated body portion having an upper tape support section and a lower tape guide section, said body portion having a length such that a user can walk upright along an edge of a trench in which tape is being layed while gripping the upper tape support section in one hand and maintaining the lower tape guide section at a desired level within the trench, tape support means secured to one side of the tape support section and extending outwardly therefrom, said tape support means including adjustable means to enable tapes of different widths to be supported thereon, tape guide means secured to one side of the tape guide section and extending outwardly therefrom on the same side of the body portion as the tape support means, and tape guide section adjusting means interconnecting the tape support section and the tape guide section of the body portion to enable the tape guide means on the tape guide section to be selectively adjusted in relation to the tape support section to facilitate positioning of tape along the side of a trench in which the tape is being layed.

5. A device according to claim 4 wherein the tape guide section adjusting means comprises pivotally mounted brackets which are selectively movable in relation to one another to enable the tape guide section to be rotated in relation to the tape support section.

6. A device according to claim 5 wherein the brackets are provided with cooperating interlocking means to enable the tape guide section to be locked in a selected position with relation to the tape support section.

* * * * *